US009065192B2

(12) United States Patent
Zhao et al.

(10) Patent No.: US 9,065,192 B2
(45) Date of Patent: Jun. 23, 2015

(54) POWER TERMINAL CONNECTOR

(71) Applicant: Tyco Electronics Corporation, Berwyn, PA (US)

(72) Inventors: Weiping Zhao, Superior Township, MI (US); Douglas Scott Simpson, Mount Clemens, MI (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 19 days.

(21) Appl. No.: 14/031,933

(22) Filed: Sep. 19, 2013

(65) Prior Publication Data

US 2015/0079856 A1 Mar. 19, 2015

(51) Int. Cl.
*H01R 4/48* (2006.01)

(52) U.S. Cl.
CPC ..... *H01R 4/48* (2013.01)

(58) Field of Classification Search
CPC .. H01R 11/288; H01R 12/592; H01R 13/187; H01R 11/282; H01R 4/4809; H01R 4/4881
USPC ..... 439/816, 33, 500, 680, 845, 846, 847, 439/844, 843, 851, 790
See application file for complete search history.

(56) References Cited

U.S. PATENT DOCUMENTS 6,287,156 B1 9/2001 Swan et al.
6,482,049 B1 * 11/2002 Swearingen ..... 439/843
6,672,911 B2 * 1/2004 Zhao et al. ..... 439/845
8,628,335 B1 * 1/2014 Zhao ..... 439/33
2012/0315802 A1 12/2012 Blackborn

FOREIGN PATENT DOCUMENTS

EP 0 202 564 A2 11/1986
EP 1 622 226 A1 2/2006
EP 2 375 506 A1 10/2011

OTHER PUBLICATIONS

International Search Report, International Application No., PCT/US2014/053983, International Filing Date, Sep. 4, 2014.

* cited by examiner

*Primary Examiner* — Edwin A. Leon

(57) ABSTRACT

A power terminal connector includes a terminal having a terminal body defining a receptacle. The terminal body has a front end open to the receptacle that receives a power terminal. The terminal body has a series of notches separated by posts at the front end. A contact spring is received in the receptacle and has a first band and a second band with spring beams extending between the first and second bands. The spring beams resiliently engage the power terminal. The bands engage the terminal body to create a power path between the terminal body and the power terminal. The first band has a series of tabs extending therefrom separated by gaps. The tabs are received in corresponding notches and the gaps receive corresponding posts to secure the contact spring in the terminal box.

20 Claims, 5 Drawing Sheets

POWER TERMINAL CONNECTOR

BACKGROUND OF THE INVENTION

The subject matter herein relates generally to power terminal connectors for connector systems.

Power terminal connectors are used in different types of connector systems. One application is an automotive application, such as for connectors of a battery of a vehicle. Some known power terminal connectors have a terminal body that receives a spring contact. The spring contact creates a power path between the terminal body and a power terminal connected thereto. However, in some applications, such as in automotive applications, vibration of the system may lead to vibration between the spring contact and the terminal body. Such vibration can cause fretting and corrosion at the interface therebetween. Additionally, the surface area of the electrical connection between the contact spring and the terminal body may be limited, leading to a high resistance across the interface.

A need remains for a power terminal connector that can withstand high vibration and that has a low electrical resistance in the power path between the power terminal connector and any power terminal.

BRIEF DESCRIPTION OF THE INVENTION

In one embodiment, a power terminal connector is provided including a terminal having a terminal body defining a receptacle. The terminal body has a front end open to the receptacle that receives a power terminal. The terminal body has a series of notches separated by posts at the front end. A contact spring is received in the receptacle and has a first band and a second band with spring beams extending between the first and second bands. The spring beams resiliently engage the power terminal. The bands engage the terminal body to create a power path between the terminal body and the power terminal. The first band has a series of tabs extending therefrom separated by gaps. The tabs are received in corresponding notches and the gaps receive corresponding posts to secure the contact spring in the terminal box.

Optionally, the tabs may be held in the notches by an interference fit. The posts may be held in the gaps by an interference fit. The notches may each have a corresponding notch width and the tabs may each have a corresponding tab width with the notch width being slightly narrower than the corresponding tab width to ensure the tabs engage the posts in an interference fit. The tabs may extend from the first band in at least two different directions. The post may be flared to create flared edges that overlap the tabs.

Optionally, the terminal body may have an interior surface defining the receptacle. The first band may engage the interior surface proximate to the first end. The tabs may extend from the first band to engage the front end of the terminal body. The terminal body may include a top wall and a bottom wall. The top wall and bottom wall may each have notches receiving corresponding tabs. The terminal body may include side walls extending between the top wall and bottom wall. The side walls may have notches receiving corresponding tabs. Optionally, the terminal body may include a rear end opposite the front end. The rear end may have notches separated by posts. The second band may have tabs extending therefrom received in corresponding notches in the rear end.

Optionally, the terminal body may be box-shaped and the contact spring may be box-shaped. The tabs may be bent approximately 90° to engage the front end. The tabs may include first and second edges and first and second sides extending between the first and second edges. Edge material of the terminal body may be flared such that the first and second edges and first and second sides may each have a point of contact with the terminal body to create a power path between the terminal body and the contact spring.

In another embodiment, a power terminal connector is provided that includes a terminal including a terminal body having a top wall, a bottom wall and opposite side walls defining a box-shaped receptacle configured to receive a flat power terminal. The terminal body has an open front end open to the receptacle and configured to receive the power terminal therethrough. The terminal body has a series of notches separated by posts at the front end. A contact spring is received in the receptacle and is electrically connected to the terminal body. The contact spring has box-shaped first and second bands with spring beams extending between the first and second bands. The spring beams resiliently engage the power terminal. The first and second bands engage the terminal body to create a power path between the terminal body and the power terminal. The first band has a series of tabs extending therefrom separated by gaps. The tabs are received in corresponding notches and the gaps receiving corresponding posts to secure the contact spring in the terminal box.

In a further embodiment, a power terminal connector is provided that includes a terminal including a terminal body having a top wall, a bottom wall and opposite side walls defining a box-shaped receptacle configured to receive a flat power terminal. The terminal body has an open front end open to the receptacle and configured to receive the power terminal therethrough. The terminal body has a rear end opposite the front end. The terminal body has a series of notches separated by posts provided at the front end and at the rear end. A contact spring is received in the receptacle and is electrically connected to the terminal body. The contact spring has box-shaped first and second bands with spring beams extending between the first and second bands that resiliently engage the power terminal. The first and second bands engage the terminal body to create a power path between the terminal body and the power terminal. The first band has a series of tabs extending therefrom separated by gaps. The second band has a series of tabs extending therefrom separated by gaps. The tabs of the first band are received in corresponding notches at the front end of the terminal body. The tabs of the second band are received in corresponding notches at the rear end of the terminal body.

DETAILED DESCRIPTION OF THE INVENTION

Figure 1:
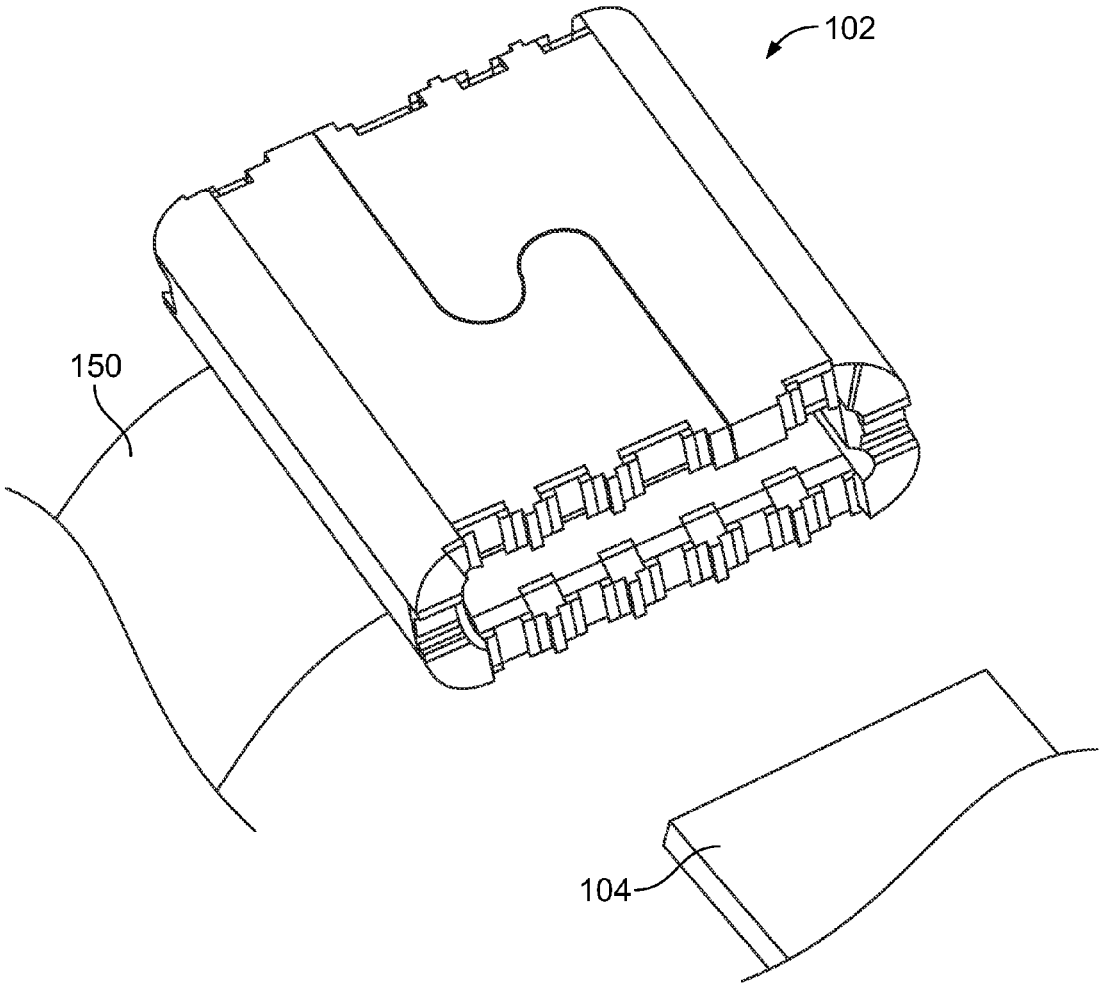
FIG. 1 illustrates a power terminal connector formed in accordance with an exemplary embodiment.

FIG. 1 illustrates a power terminal connector 102 formed in accordance with an exemplary embodiment. The power terminal connector 102 is configured to be electrically connected to a power terminal 104. The power terminal connector 102 may be electrically connected to another component 105, such as a conductor, a buss bar, a wire, a cable or another type of component. The power terminal connector 102 may supply power to the component or receive power from the component. The power terminal connector 102 is used to electrically connect the power terminal 104 with the other component.

The power terminal connector 102 may be used in different applications. For example, the power terminal connector 102 may be used as part of a power supply system. The power terminal connector 102 may be used in an automotive application, such as part of a battery system. In an exemplary embodiment, the power terminal connector 102 may be used as a battery-to-battery connector. However, the power terminal connector 102 may be used in other applications as well. The power terminal connector 102 illustrated in the Figures is illustrative of an exemplary embodiment, but may have other shapes, components or features in alternative embodiments.

Figure 2:
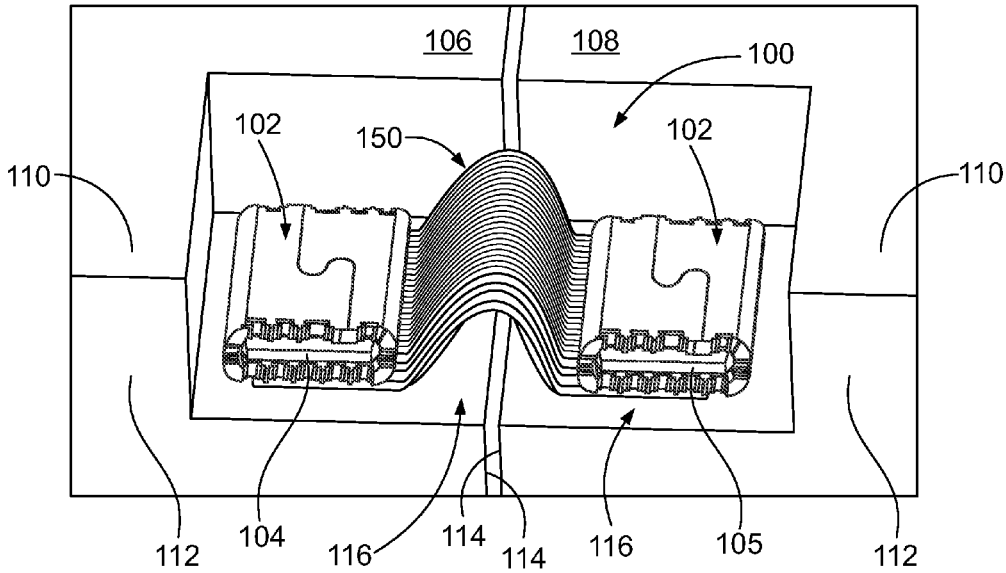
FIG. 2 illustrates a connector system that uses two of the power terminal connectors with a flexible conductor electrically connected between the first and second power terminal connectors.

FIG. 2 illustrates a connector system 100 that uses two of the power terminal connectors 102 with a flexible conductor 150 electrically connected between the first and second power terminal connectors 102. The first and second power terminal connectors 102 are each electrically connect to corresponding first and second power terminals 104, 105 (also shown in FIG. 2) of components, such as batteries 106, 108.

The power terminal connectors 102 electrically connect the batteries 106, 108. The power terminal connectors 102 and flexible conductor 150 represent a buss or jumper that interconnects the batteries 106, 108. The batteries 106, 108 may be any voltage battery used in a vehicle. Optionally, the vehicle may be an electric, hybrid-electric vehicle, or any energy storage system and the batteries 106, 108 may be used as part of the power system for the electric vehicle or hybrid-electric vehicle or any energy storage systems.

The power terminal connectors 102 are quick connect/quick disconnect types of connectors that may be easily and quickly terminated to the power terminals 104, 105 (shown in FIG. 2). The power terminal connectors 102 have a very low profile so as to conserve space around the batteries 106, 108. The power terminal connectors 102 may be connected by other types of components other than the flexible conductor 150 in alternative embodiments.

Each of the batteries 106, 108 includes a top 110, a front 112 perpendicular to the top 110, and a side 114 perpendicular to the top 110 and the front 112. The sides 114 of the batteries 106, 108 face one another. The top 110, front 112 and side 114 generally meet at a corner of the battery 106, 108. In an exemplary embodiment, the battery 106, 108 includes a notched-out area 116 at the corner. The notched-out area 116 is recessed below the top 110, behind the front 112, and inward from the side 114. The notched-out area 116 defines a window or envelope defined by planes extending along the top 110, front 112 and side 114.

The flexible conductor 150 spans across the interface between the sides 114 of the batteries 106, 108 and the power terminal connectors 102 are positioned in both notched-out areas 116. The power terminals 104, 105 are provided at the corresponding notched-out areas 116. The power terminal connectors 102 are received in the notched-out areas 116 such that the power terminal connectors 102 do not extend beyond (e.g., above) the tops 110 of the batteries 106, 108. The power terminal connectors 102 are received in the notched-out areas 116 such that the power terminal connectors 102 do not extend beyond (e.g., outward from) the fronts 112 of the batteries 106, 108. As such, other components, such as another battery may be positioned immediately in front of the batteries 106, 108 without interference from the power terminal connectors 102. Another component, such as a cover or lid may extend along the tops 110 of the batteries 106, 108 without interference from the power terminal connectors 102. In an alternative embodiment, recessing of the power terminal connectors 102 may not be necessary, such as when no space constraints are required.

In an exemplary embodiment, the flexible conductor 150 is a flexible connector that allows relative movement between the batteries 106, 108. The flexible conductor 150 may be welded to the power terminal connectors 102. For example, the flexible conductor 150 may be laser welded, ultrasonically welded or welded by other processes. In other embodiments, the flexible conductor 150 may be mechanically and electrically terminated to the power terminal connectors 102 by other means and processes. The flexible conductor 150 may be a stack of copper sheets. The flexible conductor 150 may be a wire or cable with one or more strands or wires that form the conductor. The flexible conductor 150 spans across the interface between the sides 114 and accommodates different spacing between the batteries 106, 108, movement of the batteries 106, 108, such as from vibration, and the like. In alternative embodiments, rather than a flexible conductor, another type of component may be used to connect the power terminal connectors 102, such as a buss bar, a power plate, or another type of component.

Figure 3:
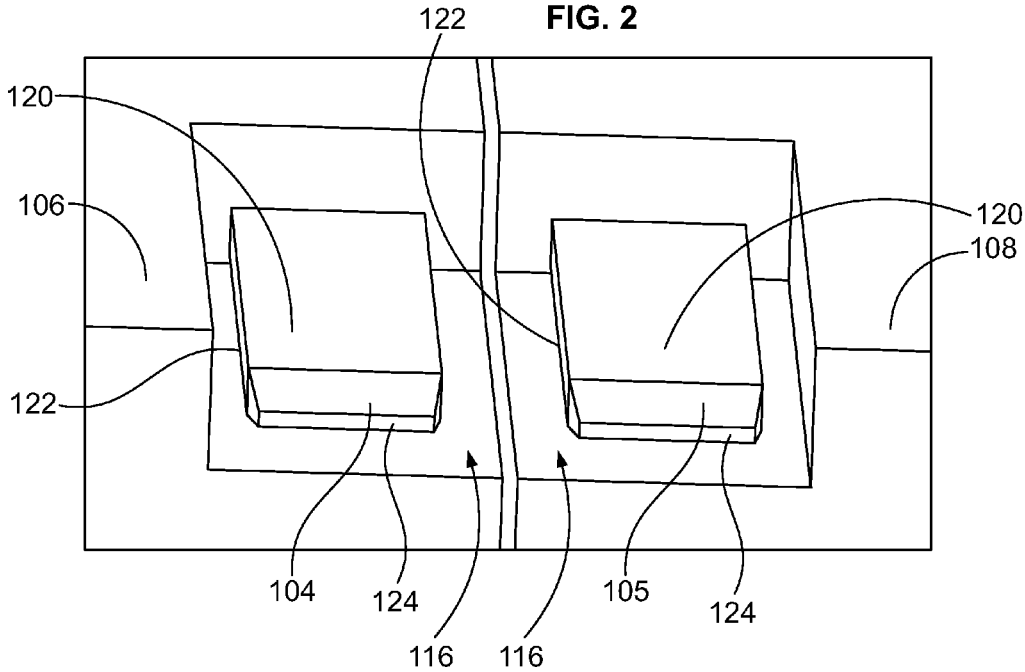
FIG. 3 illustrates a portion of batteries showing power terminals.

FIG. 3 illustrates a portion of the batteries 106, 108 showing the notched-out areas 116 with the power terminals 104, 105 extending from the batteries 106, 108 at corresponding notched-out areas 116. In an exemplary embodiment, the power terminals 104, 105 are fixed connectors of the batteries 106, 108 providing an interface for the power terminal connector 102 (shown in FIG. 1).

The power terminals 104, 105 extend from, and are electrically coupled to, the batteries 106, 108. In an exemplary embodiment, the power terminals 104, 105 are blade terminals that are generally flat and extend along blade axes (e.g. central, longitudinal axes of the power terminals 104, 105). Other types of power terminals may be used in alternative embodiments, such as posts. The power terminals may have other shapes in alternative embodiments, such as cylindrical shapes. Each of the power terminals 104, 105 includes a top 120, a bottom 122 and a tip 124. The power terminals 104, 105 are illustrated as extending horizontally, however the power terminals 104, 105 may be at other orientations, such as vertically.

With additional reference to FIG. 2, during assembly, the power terminal connectors 102 are loaded into the notched-out areas 116 through the open fronts thereof. When the power terminal connectors 102 are connected to the power terminals 104, 105, the power terminal connectors 102 electrically connect the power terminals 104, 105 through the flexible conductor 150. The power terminal connector 102 is a quick connect type connector that may be quickly and easily coupled to the power terminals 104, 105. The power terminal connector 102 may be coupled to the power terminals 104, 105 without the use of any tools. The power terminal connector 102 may be coupled by simply pressing the power terminal connector 102 onto the power terminals 104, 105 in a loading direction without any other actuation, locking or latching required.

Figure 4:
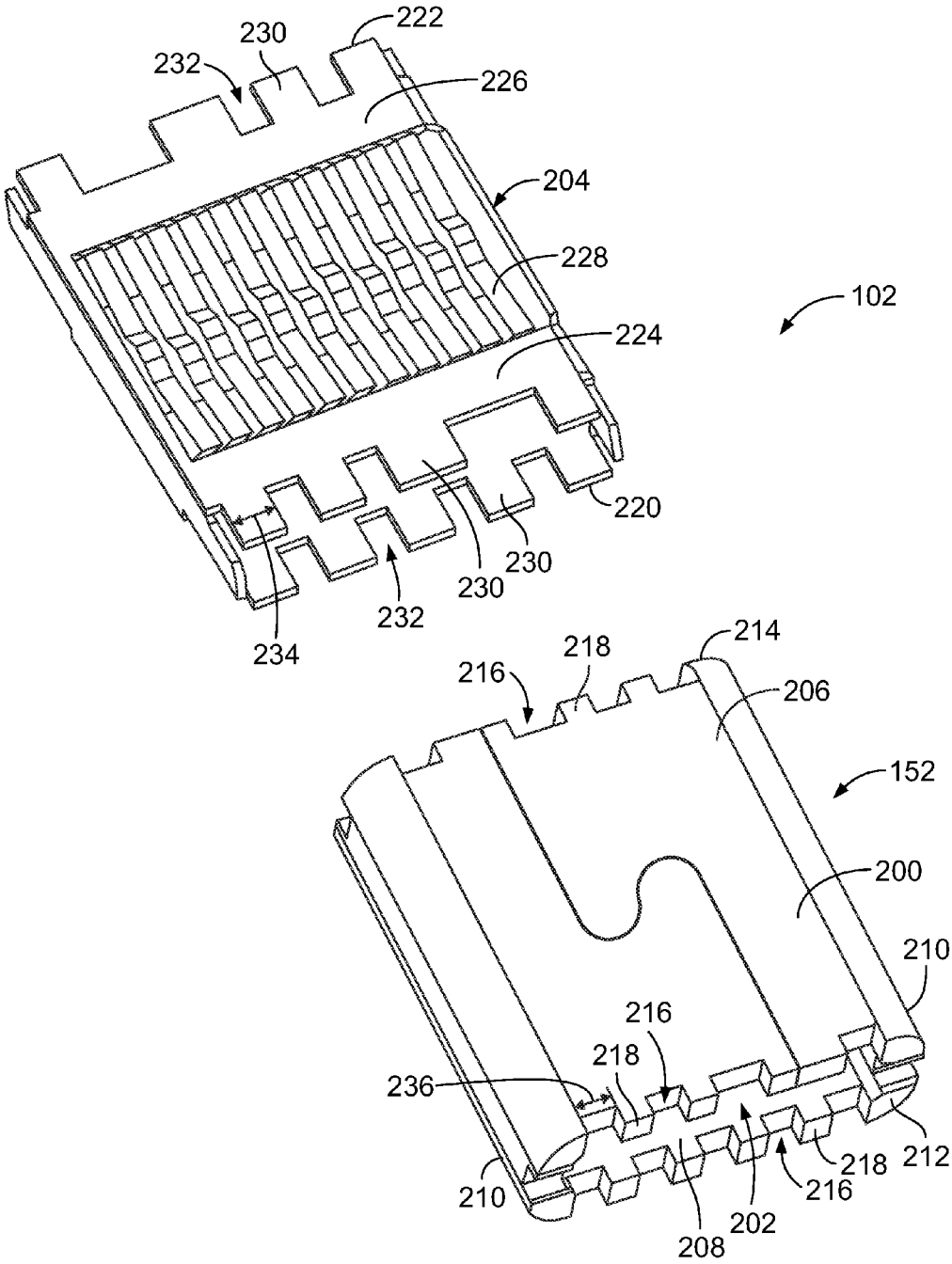
FIG. 4 is an exploded view of the power terminal connector.

FIG. 4 is an exploded view of one of the power terminal connectors 102. The power terminal connector 102 includes a terminal 152 and a contact spring 204 configured to be received in the terminal 152. The terminal 152 includes a terminal body 200 that is configured to be electrically connected to the flexible conductor 150 and the power terminal 104 (shown in FIG. 3). In an exemplary embodiment, the terminal body 200 is separately provided from, and coupled to, the flexible conductor 150 (shown in FIG. 2), such as by welding. In an exemplary embodiment, the terminal body 200 is box-shaped defining a receptacle 202. The receptacle 202 is sized and shaped to receive the power terminal 104.

The contact spring 204 is received in the receptacle 202 of the terminal body 200. The contact spring 204 is used to electrically connect the terminal body 200 to the power terminal 104. The contact spring 204 defines a power path between the terminal body 200 and the power terminal 104. The contact spring 204 provides multiple points of contact with the terminal body 200. The contact spring 204 provides multiple points of contact with the power terminal 104. The contact spring 204 defines a separable mating interface with the power terminal 104 to allow quick connection and quick disconnection. The contact spring 204 includes features for securing the contact spring 204 in the terminal body 200, such as to resist fretting during vibration of the contact spring 204 and the terminal body 200.

In the illustrated embodiment, the terminal body 200 is box-shaped having a rectangular cross-section; however other shapes are possible in alternative embodiments. The terminal body 200 includes a top wall 206, a bottom wall 208 and opposite side walls 210 that define the receptacle 202. Optionally, the flexible conductor 150 may be welded directly to the exterior of the bottom wall 208. The terminal body 200 has an open front end 212 open to the receptacle 202. The power terminal 104 is configured to be loaded into the receptacle 202 through the open front end 212. Optionally, the terminal body 200 may include an open rear end 212 opposite the front end 212. The open rear end 212 allows the power terminal 104 to pass entirely through the terminal body 200 without bottoming out against any part of the terminal body 200. In an exemplary embodiment, the terminal body 200 is a stamped and formed body having a stamped workpiece folded into the box-shape with free ends thereof being optionally secured together. Other shapes are possible in alternative embodiments.

The terminal body 200 includes securing features for securing the contact spring 204 within the receptacle 202. In the illustrated embodiment, the securing features include a series of notches 216 separated by posts 218. Optionally, the notches 216 may be provided along both the front end 212 and the rear end 214. Alternatively, the notches 216 may be provided along either the front end 212 or the rear end 214. Optionally, the notches 216 are provided along the top wall 206, the bottom wall 208 and the side walls 210. Alternatively, the notches 216 may be provided on less walls, such as the top wall 206, the bottom wall 208 or the side walls 210. The notches 216 receive portions of the contact spring 204. The contact spring 204 may be secured in the notches 216 by an interference fit. Optionally, the posts 218 may be locked around the contact spring 204. For example, the posts 218 may be flared outward into the notches 216 to capture the contact spring 204 in the notches 216. In other embodiments, latches or other features may be provided to secure the contact spring 204 in the notches 216.

The contact spring 204 extends between a front end 220 and a rear end 222. The contact spring 204 has a pair of circumferential bands, identified as a first band 224 and a second band 226 at the front and rear ends 220, 222, respectively. The first and second bands 224, 226 are configured to engage the terminal body 200 when the contact spring 204 is loaded into the receptacle 202 to electrically connect the contact spring 204 to the terminal body 200. Optionally, the bands 224, 226 may be held in the receptacle 202 by an interference fit with the top wall 206, bottom wall 208 and/or the side walls 210. Optionally, the contact spring 204 may be a stamped and formed piece.

A plurality of spring beams 228 extend between the circumferential bands 224, 226 along a top and a bottom of the contact spring 204, thus defining upper spring beams 228 and lower spring beams 228, respectively. In the illustrated embodiment, the spring beams 228 are generally inwardly tapered towards the middle of the contact spring 204. The upper and lower spring beams 228 extend toward each other at the center of the receptacle 202. The shape of the spring beams 228 ensure that the spring beams 228 engage the power terminal 104 when loaded therein. In an exemplary embodiment, the spring beams 228 are deflectable and may be deflected outward when the power terminal 104 is loaded into the contact spring 204. The contact spring 204 defines an electrical path between the power terminal 104 and the terminal body 200.

The contact spring 204 includes securing features for securing the contact spring 204 within the receptacle 202. In the illustrated embodiment, the securing features include a series of tabs 230 separated by gaps 232. The tabs 230 may be stamped with the contact spring 204 and bent into form. Optionally, the tabs 230 may extend from both the first band 224 and the second band 226. Alternatively, the tabs 230 may be provided along either the first band 224 or the second band 226. Optionally, the tabs 230 may extend generally perpendicular from the bands 224, 226. For example, the tabs 230 may be bent at approximately 90°. Optionally, the tabs 230 may extend from the first band 224 in at least two different directions. For example, the tabs 230 may extend upward from the top, extend downward from the bottom and extend outward from both sides of the corresponding bands 224, 226. Alternatively, the tabs 230 may be provided on fewer portions of the bands 224, 226, such as only the top or only the bottom.

The tabs 230 are received in corresponding notches 216. The gaps 232 receive corresponding posts 218. The tabs 230 may be secured in the notches 216 by an interference fit with the adjacent posts 218. The posts 218 may be secured in the gaps 232 by an interference fit with the adjacent tabs 230. Optionally, the posts 218 may be locked around the tabs 230. For example, the posts 218 may be flared outward in front of the tabs 230 to capture the tabs 230 in the notches 216.

Figure 5:
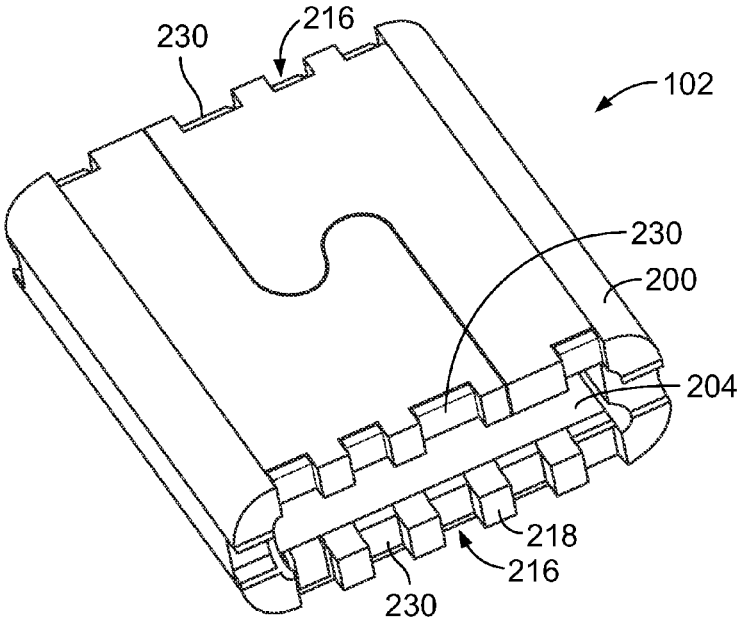
FIG. 5 is a front perspective view of the power terminal connector.

The tabs 230 have corresponding tab widths 234. Optionally, different tabs 230 may have different tab widths 234. The notches 216 have corresponding notch widths 236. Optionally, different notches 216 may have different notch widths 236. The notches 216 and tabs 230 may be keyed, such as by having certain widths, to ensure a single orientation of the contact spring 204 in the terminal body 200. Optionally, the tabs 230 may be secured in the notches 216 by other means, such as by flaring the posts 218 to lock the tabs 230 in the notches 216. Alternatively, the notch widths 236 may be slightly narrower than the corresponding tab widths 234 such that the tabs 230 must be forced to fit into the notches 216. The tabs 230 are then held in the notches 216 by an interference fit FIG. 5 is a front perspective view of the power terminal connector 102 showing the contact spring 204 loaded into the terminal body 200. The tabs 230 are received in corresponding notches 216 to secure the contact spring 204 in the receptacle 202. The tabs 230 may be held in the notches 216 by an interference fit. Such interference fit reduces fretting induced during vibration of the power terminal connector 102. Optionally, the power terminal connector 102 may be used as shown without flaring the posts 218 (example of flaring as shown with reference back to FIG. 1 and/or FIG. 6).

Figure 6:
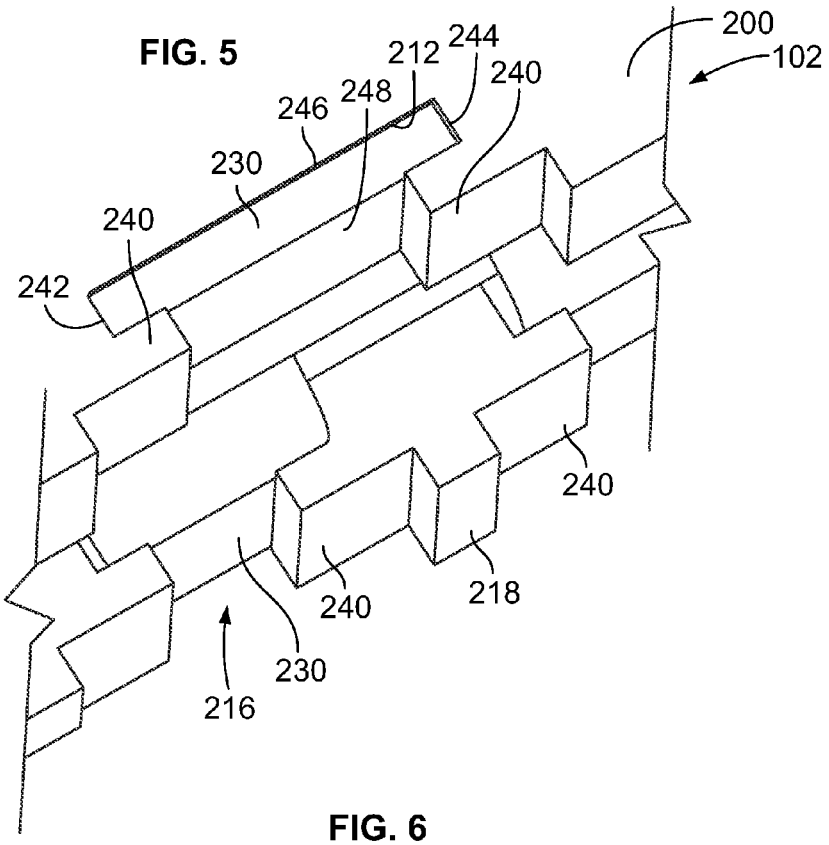
FIG. 6 is an enlarged view of a portion of the power terminal connector.

FIG. 6 is an enlarged view of a portion of the power terminal connector 102. FIG. 6 illustrates the posts 218 flared to secure the tabs 230 in the corresponding notches 216. The posts 218 may be flared by a tool or die.

The posts 218 are flared outward into the notches 216 to form flared edges 240. The flared edges 240 overlap the tabs 230 to lock the tabs 230 in the notches 216. The flared edges 240 engage the tabs 230 to create points of contact with the corresponding tabs 230. In an exemplary embodiment, at the front end 212 of the terminal body 200 (however a similar arrangement may occur at the rear end 214), each tab 230 engages the front end 212 to create one or more points of contact therewith, each tab 230 engages one or both posts 218 on each side of the corresponding tab 230 to create one or more points of contact therewith and each tab 230 engages one or more flared edges 240 to create one or more points of contact therewith. For example, the tabs 230 each include first and second edges 242, 244 and first and second sides 246, 248 extending between the first and second edges 242, 244. The first and second edges 242, 244 and first and second sides 246, 248 each have at least one point of contact with the terminal body 200 to create a power path between the terminal body 200 and the contact spring 204. For example, the first and second edges 242, 244 engage the posts 218. The first side 246 engages the front end 212. The second side 248 engages the flared edges 240. Furthermore, the first band 224 may engage the terminal body 200 to create one or more points of contact therewith. Each point of contact defines a power path between the contact spring 204 and the terminal body 200. Having many points of contact between the contact spring 204 and the terminal body 200 lowers the resistance across such interface and allows higher current to flow across the interface.

Figure 7:
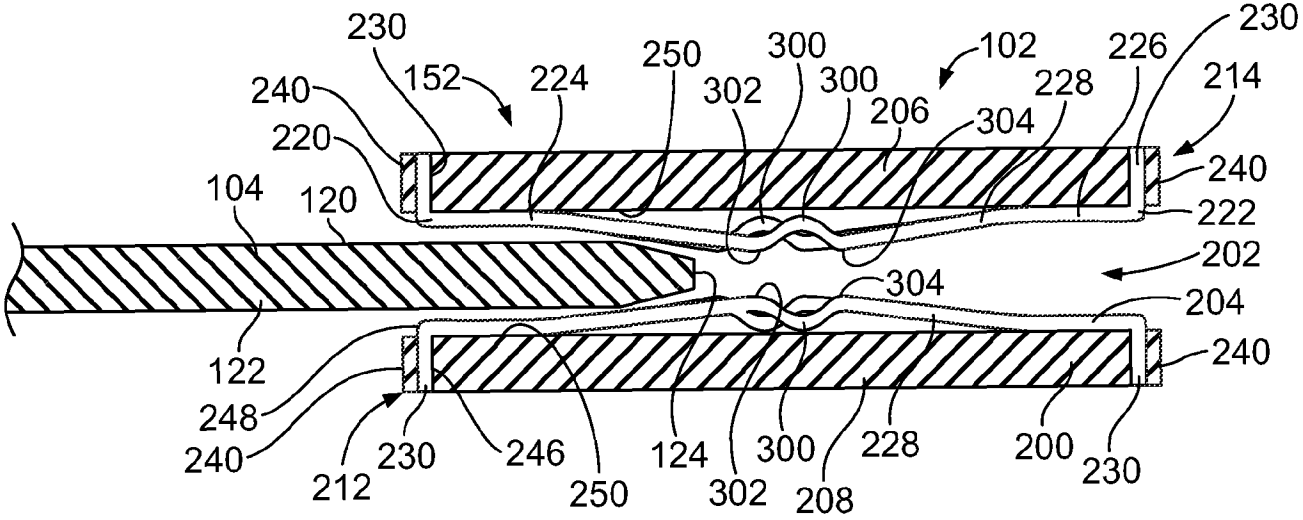
FIG. 7 is a cross sectional view of a portion of the power terminal connector showing a power terminal loaded into the power terminal connector.

FIG. 7 is a cross sectional view of a portion of the power terminal connector 102 showing the power terminal 104 being loaded into the terminal 152. The tip 124 of the power terminal 104 is loaded into the receptacle 202 and into the contact spring 204. The upper and lower spring beams 228 engage the top 120 and bottom 122 of the power terminal 104 to electrically connect the terminal 152 to the power terminal 104.

The contact spring 204 is loaded into the receptacle 202 such that the first and second bands 224, 226 abut against and engages interior surfaces 250 of the top and bottom walls 206, 208 (and the side walls 210 shown in FIG. 2) proximate to the front and rear ends 212, 214, respectively. The bands 224, 226 each define at least one point of contact with the terminal body 200 to create an electrical power path between the contact spring 204 and the terminal body 200. The tabs 230 extend from the first and second bands 224, 226 along the front and rear ends 212, 214. The first side 246 of each tab 230 engages the front end 212 to create one or more points of contact with the terminal body 200. The second side 248 of each tab engages the flared edge(s) 240 when the flared edge (s) 240 are pressed against the second side 248 to create one or more points of contact with the terminal body 200.

In an exemplary embodiment, each of the spring beams 228 may define an additional point of contact with the terminal body 200 to create another electrical power path between the contact spring and the terminal body 200. For example, in an exemplary embodiment, each spring beam 228 includes an overstress bump 300 facing outward toward the terminal body 200. When the power terminal 104 is loaded into the terminal 152, the spring beams 228 are deflected outward. The overstress bumps 300 are forced outward until the overstress bumps 300 engage the terminal body 200. The spring beams 228 are electrically connected to the terminal body 200 via the direct engagement between the overstress bumps 300 and the terminal body 200, such as along the top wall 206 or the bottom wall 208. The overstress bumps 300 limit the amount of deflection of the spring beams 228 preventing overstress and/or plastic deformation of the spring beams 228. When the overstress bumps 300 engage the terminal body 200 further deflection of the spring beams 228 increases the spring force imparted onto the power terminal 104 because the effective beam length of the spring beams 228 is reduced when the overstress bumps 300 engage the terminal body 200.

In an exemplary embodiment, each of the spring beams 228 includes at least two contact bumps 302, 304. The contact bumps 302, 304 define interfaces of the spring beams 228 that are configured to engage the power terminal 104. As such, each spring beam 228 includes multiple points of contact with the power terminal 104 creating a better electrical connection therebetween. The contact bumps 302, 304 are the interior-most portions of the spring beams 228 that are furthest interior from the terminal body 200. The contact bumps 302, 304 are the portions of the spring beams 228 that directly engage the power terminal 104 when the power terminal 104 is loaded into the terminals 152. Optionally, the contact bumps 302, 304 may be defined by the overstress bump 300. For example, the contact bumps 302 304 may be located where the spring beams 228 start to transition or are formed outward to define the overstress bumps 300. The overstress bumps 300 are located between the contact bumps 302, 304.

Optionally, the overstress bumps 300 and corresponding contact bumps 302, 304 may be approximately centered along the spring beams 228 between the first and second bands 224, 226. Optionally, the spring beams 228 may be formed with offset overstress bumps 300 and offset contact bumps 302, 304. For example, adjacent spring beams 228 may have the bumps 300, 302, 304 offset to a forward position or a rearward position (e.g. closer to the front end 220 or closer to the rear end 222, respectively). Such staggering reduces the total insertion force for mating the power terminal connector 102 to the power terminal 104. Optionally, rather than having each alternating spring beam 228 staggered, other patterns of offsetting of the bumps 300, 302, 304 may be utilized, such as having all of the upper spring beams 228 being staggered forward and all of the lower spring beams 228 staggered rearward. Optionally, the bumps 300, 302, 304 may be staggered at more than two different positions.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A power terminal connector comprising:

a terminal having a terminal body defining a receptacle, the terminal body having a front end open to the receptacle, the receptacle being configured to receive a power terminal through the open front end, the terminal body having a series of notches separated by posts at the front end; and a contact spring received in the receptacle, the contact spring having a first band and a second band, the contact spring having spring beams extending between the first and second bands, the spring beams resiliently engaging the power terminal, the bands engaging the terminal body to create a power path between the terminal body and the power terminal, the first band having a series of tabs extending therefrom separated by gaps, the tabs being received in corresponding notches and the gaps receiving corresponding posts to secure the contact spring in the terminal box.

2. The power terminal connector of claim 1, wherein the tabs are held in the notches and are electrically connected to the terminal body in the notches.

3. The power terminal connector of claim 1, wherein the posts are held in the gaps and are electrically connected to the contact spring.

4. The power terminal connector of claim 1, wherein the tabs extend from the first band in at least two different directions.

5. The power terminal connector of claim 1, wherein the posts are flared to create flared edges, the flared edges overlap and engage the tabs.

6. The power terminal connector of claim 1, wherein the terminal body has an interior surface defining the receptacle, the first band engaging the interior surface proximate to the first end, the tabs extending from the first band to engage the front end of the terminal body.

7. The power terminal connector of claim 1, wherein the notches each have a corresponding notch width and the tabs each have a corresponding tab width, the notch width being slightly narrower than the corresponding tab width to ensure the tabs engage the posts in an interference fit.

8. The power terminal connector of claim 1, wherein the terminal body includes a top wall and a bottom wall, the top wall and bottom wall each having notches receiving corresponding tabs.

9. The power terminal connector of claim 8, wherein the terminal body includes side walls extending between the top wall and bottom wall, the side walls having notches receiving corresponding tabs.

10. The power terminal connector of claim 1, wherein the terminal body includes a rear end opposite the front end, the rear end having notches separated by posts, the second band having tabs extending therefrom received in corresponding notches in the rear end.

11. The power terminal connector of claim 1, wherein the terminal body is box-shaped and the contact spring is box-shaped.

12. The power terminal connector of claim 1, wherein the tabs are bent approximately 90° to engage the front end.

13. The power terminal connector of claim 1, wherein the tabs include first and second edges and first and second sides extending between the first and second edges, the first and second edges and first and second sides each having a point of contact with the terminal body to create a power path between the terminal body and the contact spring.

14. A power terminal connector comprising:

a terminal including a terminal body having a top wall, a bottom wall and opposite side walls defining a box-shaped receptacle configured to receive a flat power terminal, the terminal body having an open front end open to the receptacle and configured to receive the power terminal therethrough, the terminal body having a series of notches separated by posts at the front end; and a contact spring received in the receptacle and being electrically connected to the terminal body, the contact spring having box-shaped first and second bands, the contact spring having spring beams extending between the first and second bands, the spring beams resiliently engaging the power terminal, the first and second bands engaging the terminal body to create a power path between the terminal body and the power terminal, the first band having a series of tabs extending therefrom separated by gaps, the tabs being received in corresponding notches and the gaps receiving corresponding posts to secure the contact spring in the terminal box.

15. The power terminal connector of claim 14, wherein the tabs are held in the notches and are electrically connected to the terminal body in the notches.

16. The power terminal connector of claim 14, wherein the post are flared to create flared edges, the flared edges overlap the tabs.

17. The power terminal connector of claim 14, wherein the terminal body has an interior surface defining the receptacle, the first band engaging the interior surface proximate to the first end, the tabs extending from the first band to engage the front end of the terminal body.

18. The power terminal connector of claim 14, wherein the terminal body includes a rear end opposite the front end, the rear end having notches separated by posts, the second band having tabs extending therefrom received in corresponding notches in the rear end.

19. A power terminal connector comprising:

a terminal including a terminal body having a top wall, a bottom wall and opposite side walls defining a box-shaped receptacle configured to receive a flat power terminal, the terminal body having an open front end open to the receptacle and configured to receive the power terminal therethrough, the terminal body having a rear end opposite the front end, the terminal body having a series of notches separated by posts, the notches and posts being provided at the front end and at the rear end; and a contact spring received in the receptacle and being electrically connected to the terminal body, the contact spring having box-shaped first and second bands, the contact spring having spring beams extending between the first and second bands, the spring beams resiliently engaging the power terminal, the first and second bands engaging the terminal body to create a power path between the terminal body and the power terminal, the first band having a series of tabs extending therefrom separated by gaps, the second band having a series of tabs extending therefrom separated by gaps, the tabs of the first band being received in corresponding notches at the front end of the terminal body, the tabs of the second band being received in corresponding notches at the rear end of the terminal body.

20. The power terminal connector of claim 19, wherein the post are flared to create flared edges, the flared edges overlap and engage the corresponding tabs.

* * * * *